US007012357B2

(12) United States Patent
Kim

(10) Patent No.: US 7,012,357 B2
(45) Date of Patent: Mar. 14, 2006

(54) SHADOW MASK STRUCTURE FOR CATHODE RAY TUBE

(75) Inventor: Sung Hun Kim, Busan-si (KR)

(73) Assignee: LG. Philips Displays Korea Co., Ltd., (KR)

( * ) Notice: Subject to any disclaimer, the term of this patent is extended or adjusted under 35 U.S.C. 154(b) by 109 days.

(21) Appl. No.: 10/699,654

(22) Filed: Nov. 4, 2003

(65) Prior Publication Data

US 2004/0095053 A1 May 20, 2004

(30) Foreign Application Priority Data

Nov. 20, 2002 (KR) ..... 10-2002-0072189

(51) Int. Cl.
*H01J 29/80* (2006.01)

(52) U.S. Cl. ..... 313/402; 313/407

(58) Field of Classification Search ..... 313/402, 313/407

See application file for complete search history.

(56) References Cited

U.S. PATENT DOCUMENTS

| | | | | |
|---|---|---|---|---|
| 5,057,737 | A | 10/1991 | Hotta | |
| 5,189,334 | A | 2/1993 | Park | |
| 6,051,918 | A * | 4/2000 | Hayashi et al. | 313/407 |
| 6,111,346 | A | 8/2000 | Ito et al. | |
| 6,208,067 | B1 * | 3/2001 | Nakagawa et al. | 313/461 |
| 6,437,497 | B1 * | 8/2002 | Ito et al. | 313/402 |
| 6,680,565 | B1 * | 1/2004 | Pyun et al. | 313/477 R |

* cited by examiner

*Primary Examiner*—Mariceli Santiago

*Assistant Examiner*—Anthony Perry

(74) *Attorney, Agent, or Firm*—McKenna Long & Aldridge, LLP

(57) ABSTRACT

The present invention relates to a cathode ray tube, and more particularly to a cathode ray tube having a shadow mask for obviating doming phenomenon caused by thermal expansion and deterioration of color purity.

24 Claims, 10 Drawing Sheets

SHADOW MASK STRUCTURE FOR CATHODE RAY TUBE

This application claims the benefit of Korean Patent Application No. 2002-72189, filed on Nov. 20, 2002, which is hereby incorporated by reference for all purposes as if fully set forth herein.

BACKGROUND OF THE INVENTION

1. Field of the Invention

The present invention relates to a cathode ray tube, and more particularly, to a cathode ray tube having a shadow mask for obviating doming phenomenon caused by thermal expansion and deterioration of color purity.

2. Discussion of the Related Art

FIG. 1 illustrates the structure of a color cathode ray tube according to a related art.

Referring to FIG. 1, the cathode ray tube includes a front side glass panel 1, and a rear side glass funnel 2 welded to the panel 1. The panel 1 and the funnel 2 are welded to each other in such a manner that their interior is in a vacuum state, thereby forming a vacuum tube.

A fluorescent screen 4 is formed on the inside surface of the panel 1, and an electron gun 8 is mounted on a neck portion 10 of the funnel 2 opposite of the fluorescent screen 4. A shadow mask 3 with a color selecting function is situated between the fluorescent screen 4 and the electron gun 8, maintaining a predetermined distance from the fluorescent screen 7. The shadow mask 3 is supported by a mask frame 14. Also, the mask frame 14 is elastically supported by a mask spring 5 and connected to a stud pin 6 to be supported by the panel 1.

The mask frame 14 is joined with an inner shield 7 made of a magnetic material. The inner shield 7 reduces the movement of an electron beam 11 due to external magnetic field during operation of the cathode ray tube. A deflection yoke 9 for deflecting the electron beam 11 emitted from the electron gun 8 is mounted into the neck portion 10 of the funnel 2. Also, a reinforcing band 12 is included in order to reinforce the front surface glass under the influence of the vacuum state inside the tube.

In operation, the electron beam 11 emitted from the electron gun 8 is deflected vertically and horizontally by the deflection yoke 9, and the deflected electron beam 11 passes through a beam passing hole on the shadow mask 3 and strikes the fluorescent screen 4 on the front, consequently displaying a desired color image.

FIG. 2 illustrates a shadow mask before it undergoes a press-forming process, and FIG. 3 illustrates the shadow mask of FIG. 2 after it undergoes a press-forming process.

Referring to FIGS. 2 and 3, a skirt 15 of the shadow mask 3 (before it undergoes the press-forming process) includes a slit 17 and a guide slit 18. The slit 17 serves to prevent the skirt 15 from being wrinkled and the guide slit 18 is used as a base position during the press-forming process of the shadow mask 3.

After the shadow mask 3 is press-formed, the skirt 15 is bent at right angles to a portion where beam passing holes are formed, and an embossment 16 is formed in order to promote formation of the skirt 15 and reinforce the strength of the skirt 15.

Then, the shadow mask 3 is fitted in the cathode ray tube by welding a welding portion 19 of the skirt 15 and the mask frame 14 together.

FIG. 4 is a schematic view illustrating a doming phenomenon in which the shadow mask 3 undergoes a deformation due to thermal expansion, and the electron beams 11 miss the intended target or mis-land on the fluorescent screen 4 because of the deformation. Some of the electron beams 11 do not pass through the beam passing holes of the shadow mask 3, and irradiate the inside surface of the shadow mask 3 instead. As a result, the shadow mask 3 is heated by the energy from the electron beams. As the temperature of the shadow mask 3 increases, the shadow mask is thermally expanded. Hence, the shadow mask 3 and the beam passing holes formed on the shadow mask 3 also undergo the thermal deformation. Subsequently, the trajectory of the electron beams 11 arriving at the fluorescent screen 4 is changed and the electron beams 11 mis-land.

FIG. 5 is a schematic view illustrating the thermal deformation of the mask frame and the shifting of the shadow mask position, eventually causing the electron beams to mis-land. The increased temperature (heat) of the shadow mask 3 through energy from the electron beams 11 is transferred to the mask frame 14, causing the mask frame 14 to thermally expand. This thermally expanded mask frame 14 then causes the shadow mask 3 to be displaced in the opposite direction of the original thermal displacement direction.

FIG. 6 is a diagram illustrating the degree of mis-landed electron beams due to the thermal deformation of the shadow mask and the mask frame. The thermal deformation depicted in FIGS. 4 and 5 changes the position of the shadow mask 3. At first, the degree of mis-landed electron beams increases when the shadow mask is thermally deformed as shown in FIG. 4. Then, the degree of mis-landed electron beams decreases when the mask frame 14 undergoes thermal deformation.

When the electron beams mis-land, color purity of the cathode ray tube deteriorates and it becomes difficult to correct the electron beams' landing problem.

To obviate this problem, a bimetal mask spring was used to compensate for thermal deformation of the mask frame, but this was not sufficient to solve the problem completely. Instead, the highly expensive mask spring only increased manufacturing cost of the cathode ray tube.

SUMMARY OF THE INVENTION

Accordingly, the present invention is directed to a cathode ray tube that substantially obviates one or more of the problems due to limitations and disadvantages of the related art.

An advantage of the present invention is to provide a cathode ray tube with a shadow mask capable of suppressing a doming phenomenon caused by thermal deformation and obviating deterioration of color purity.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the preferred embodiment of the present invention provides a cathode ray tube including: a front side (or face) glass panel; a funnel welded into the panel forming a vacuum envelope; a fluorescent screen formed on an inside surface of the panel; a shadow mask with a color selection function being spaced out from the fluorescent screen by a predetermined distance, wherein a ratio (%) of a length of a skirt (S) to a length of a long side (X) of the shadow mask preferably satisfies a condition of 4.1%≦S/X≦5.2%; a mask frame welded into the shadow mask; an electron gun fitted in a neck portion of the funnel; and a deflection yoke for deflecting electron beams emitted from the electron gun in horizontal and vertical directions.

In another aspect, the preferred embodiment of the present invention is to provide a cathode ray tube including: a front side (or face) glass panel; a funnel welded into the panel forming a vacuum envelope; a fluorescent screen formed on an inside surface of the panel; a shadow mask with a color selection function being spaced out from the fluorescent screen by a predetermined distance, wherein a ratio (%) of a length of a skirt (S) to a length of a short side (Y) of the shadow mask preferably satisfies a condition of 5.4%≦S/Y≦6.8%; a mask frame welded into the shadow mask; an electron gun fitted in a neck portion of the funnel; and a deflection yoke for deflecting electron beams emitted from the electron gun in horizontal and vertical directions.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF ILLUSTRATED EMBODIMENTS

Reference will now be made in detail to an embodiment of the present invention, example of which is illustrated in the accompanying drawings.

Figure 1:
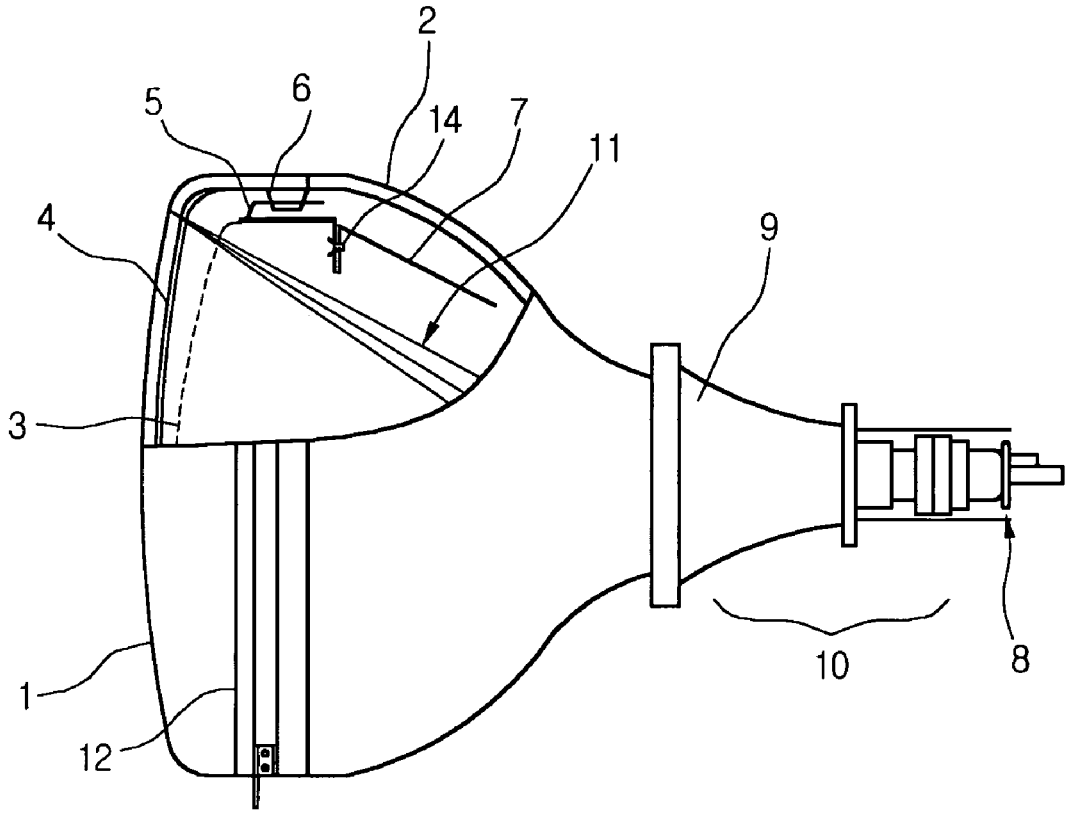
Fig.1 (Related Art)
FIG. 1 illustrates the structure of a color cathode ray tube according to a related art.
Figure 2:
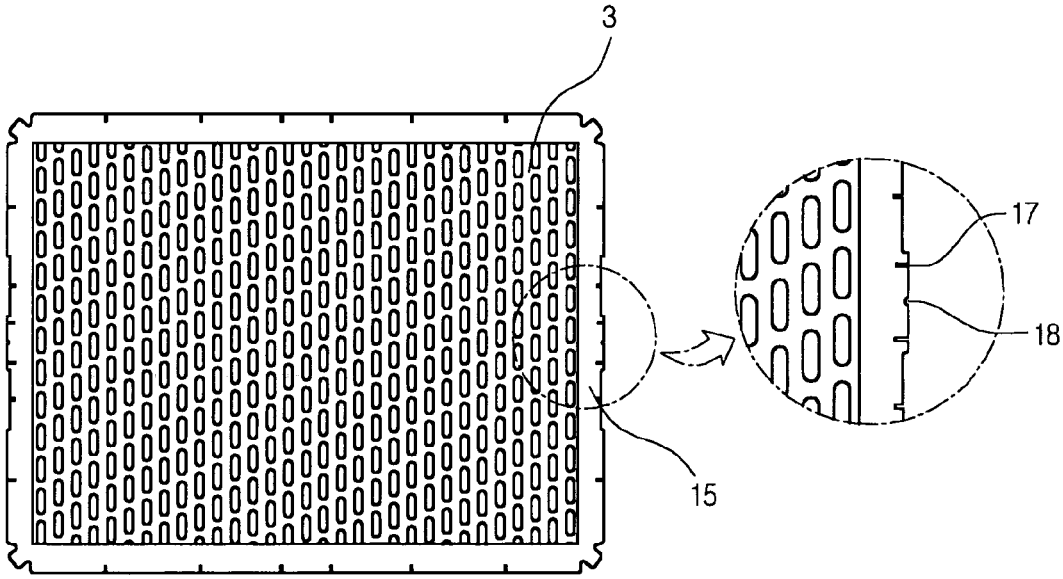
Fig.2 (Related Art)
FIG. 2 is a schematic view illustrating a shadow mask before it undergoes a press-forming process.
Figure 3:
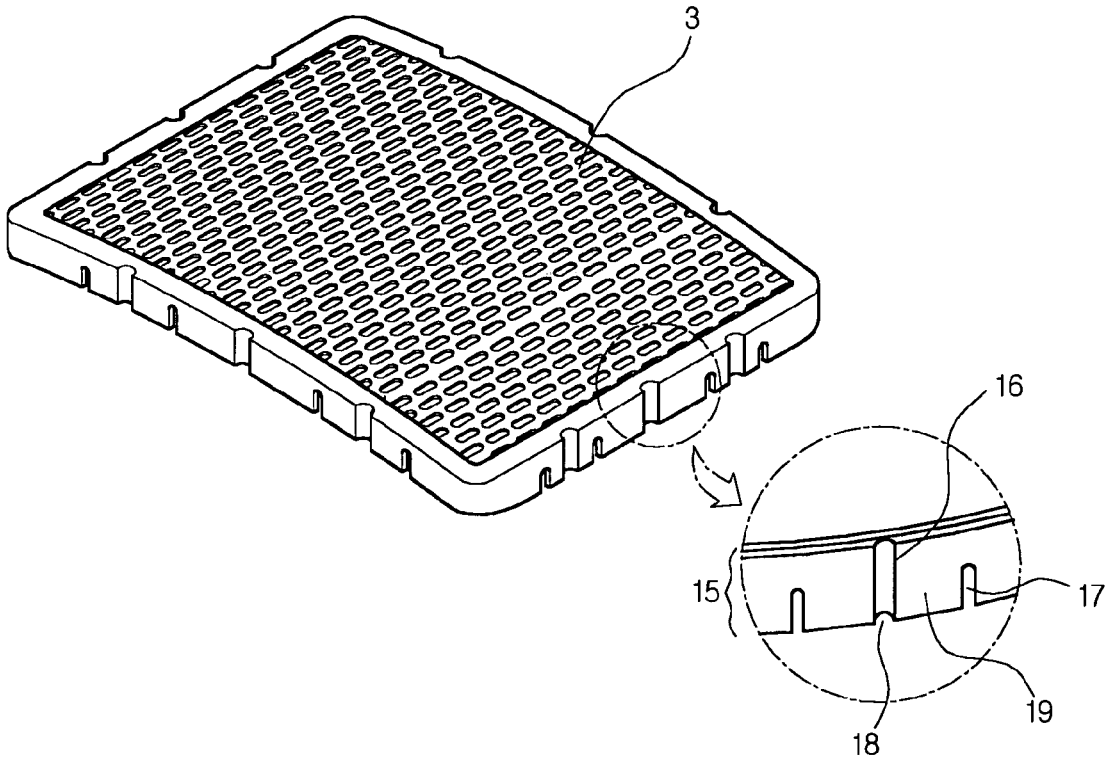
Fig.3 (Related Art)
FIG. 3 is a schematic view illustrating the shadow mask illustrated in FIG. 2 after it undergoes a press-forming process.
Figure 4:
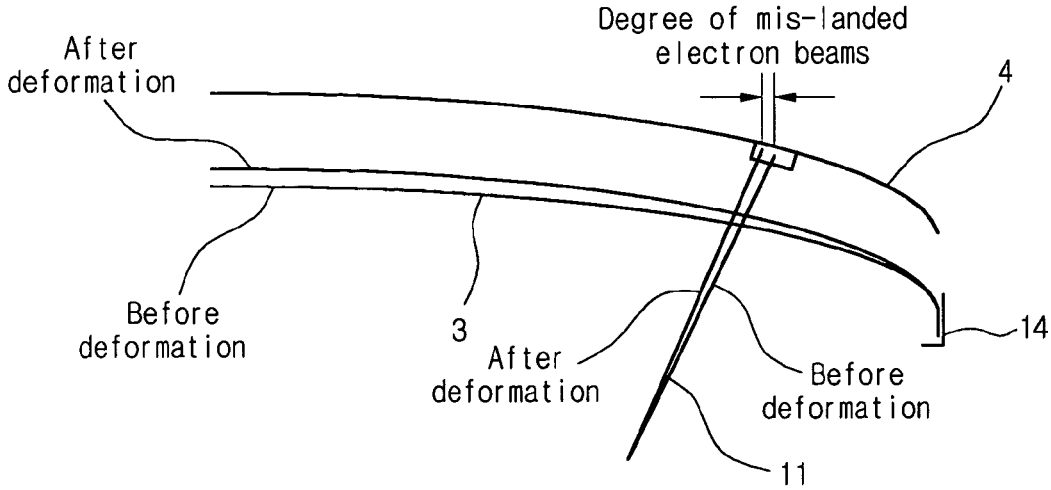
Fig.4 (Related Art)
FIG. 4 is a schematic view illustrating a doming phenomenon in which the shadow mask illustrated in FIG. 3 undergoes a deformation due to thermal expansion and electron beams mis-land.
Figure 5:
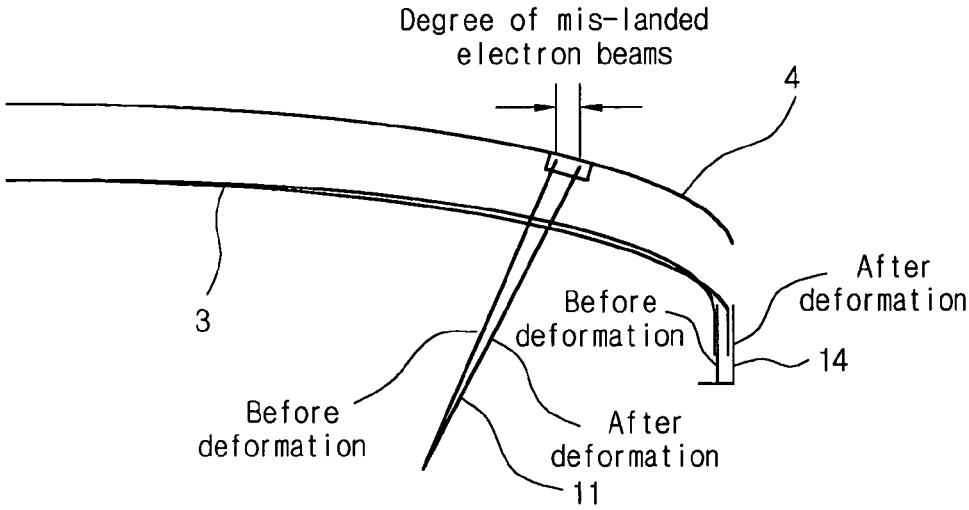
Fig.5 (Related Art)
FIG. 5 is a schematic view illustrating the thermal deformation of the mask frame and the shifting of the shadow mask position, eventually causing the electron beams to be mis-landed.
Figure 6:
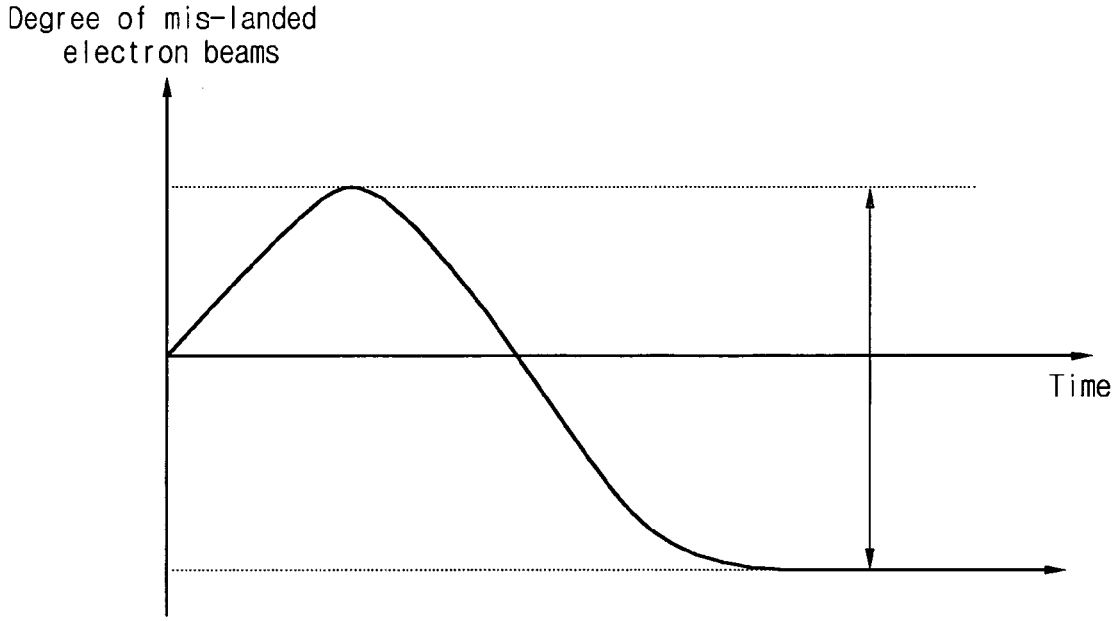
Fig.6 (Related Art)
FIG. 6 is a diagram illustrating the mis-landing degree of the electron beams due to the thermal deformation of the shadow mask and the mask frame.
Figure 7:
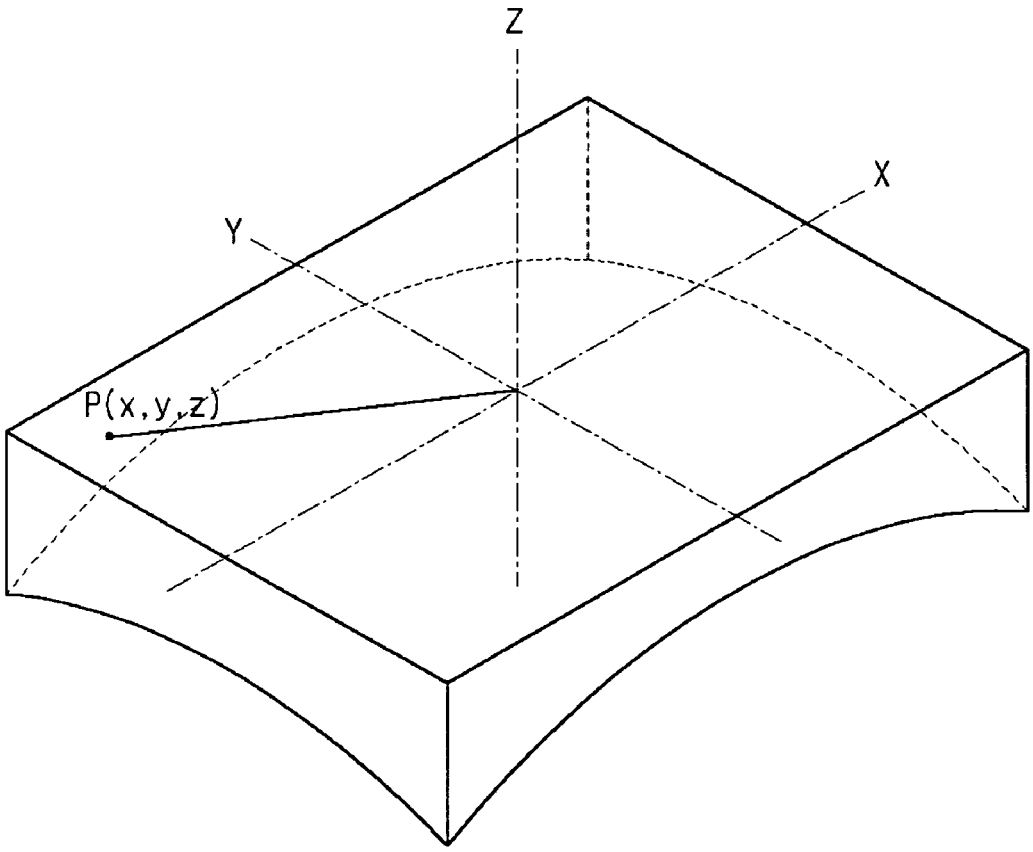
FIG. 7 is a schematic view illustrating a panel having a substantially flat outside surface and a curved inside surface.

The present invention is directed to obviating a doming phenomenon and deterioration of color purity by changing the length of a skirt of a shadow mask. The cathode ray tube according to an embodiment of the present invention comprises a front side (or face) glass panel, a funnel welded into the panel forming a vacuum envelope, a fluorescent screen formed on an inside surface of the panel, a shadow mask with a color selection function being spaced out from the fluorescent screen by a predetermined distance, a mask frame welded into the shadow mask and elastically suspended by means of a mask spring and coupled to the panel through a stud pin, an electron gun fitted in a neck portion of the funnel, and a deflection yoke for deflecting electron beams emitted from the electron gun in the horizontal and vertical directions. Beneficially, an inside surface of the panel has a predetermined curvature and an outside surface of the panel is substantially flat. More specifically, suppose that there is an arbitrary point, P (x, y, z), on the outside surface of the panel, as shown in FIG. 7. To maintain a good sense of flatness of the screen and uniform brightness, the point, P, should satisfy a condition of $$50{,}000\ \text{mm} \le \frac{\sqrt{(x^2+y^2)^2}+z^2}{2z} \le 100{,}000\ \text{mm}.$$

Also, a diagonal curvature radius of the inside surface of the panel is beneficially in the range of 1.5R–4R.

In general, the diagonal curvature radius of the inside surface of the panel has a great impact on the sense of flatness of the screen, the uniformity of brightness, contrast, and strength of the shadow mask. With the diagonal curvature radius limited to 1.5R–4R, it is possible to prevent the diagonal portion of the screen from being too thick without losing the above features, i.e. maintaining the sense of flatness of the screen, the uniformity of brightness and contrast, and securing the mechanical strength of the shadow mask.

Considering that the shadow mask is usually formed to completely cover the inside surface curvature radius of the panel, a diagonal curvature radius of an inside surface of the shadow mask is preferably in the range of 1.5R–4R also. Here, 1R=1.767×a diagonal length of an effective surface. That is, 1R equals to 1.767 times a diagonal length of an effective surface of the screen.

Figure 8:
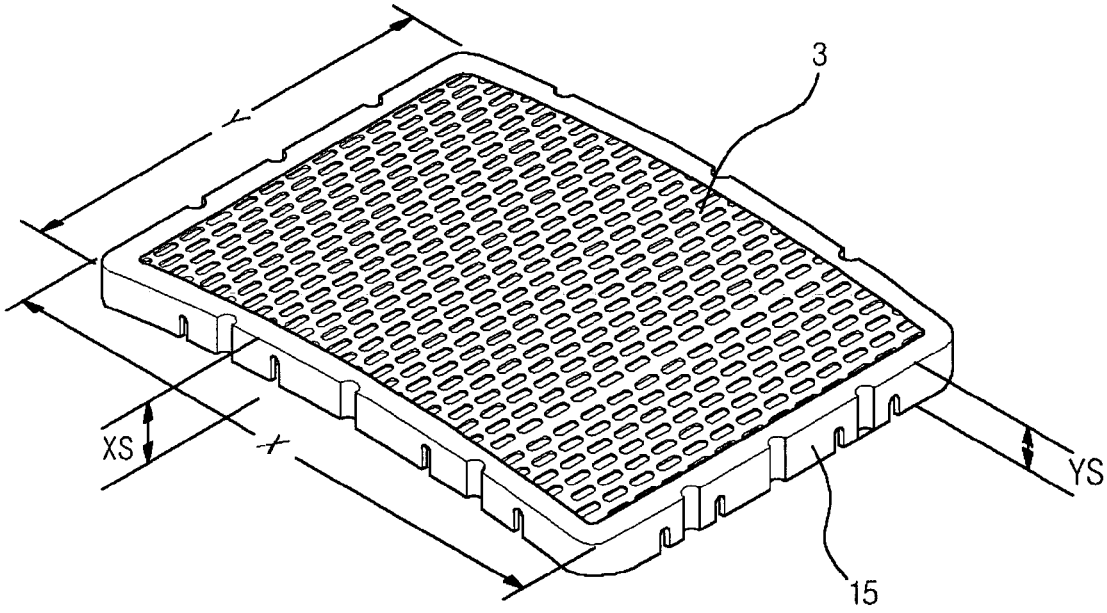
FIG. 8 is a schematic view illustrating lengths of the long side and the short side of a shadow mask for a cathode ray tube according to the present invention.
Figure 9:
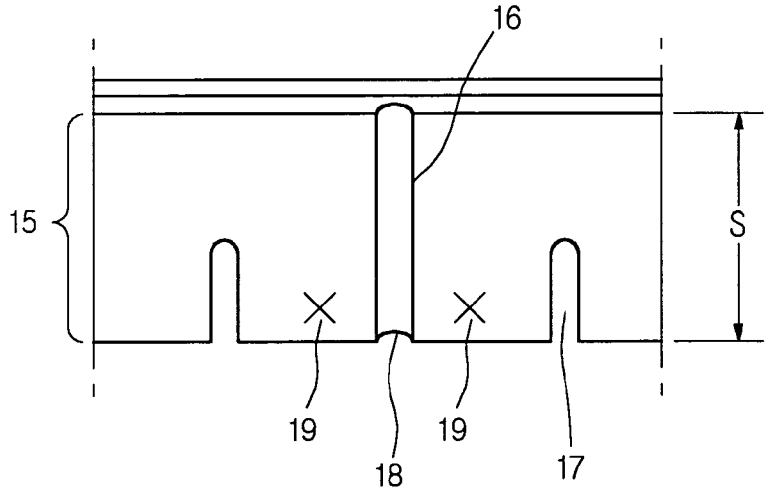
FIG. 9 is a schematic view illustrating a length of a skirt of the shadow mask for the cathode ray tube according to the present invention.

FIG. 8 is a schematic view illustrating lengths of the long side and the short side of the shadow mask for a cathode ray tube according to the present invention. FIG. 9 is a schematic view illustrating the length of the skirt of the shadow mask for the cathode ray tube according to the present invention. Referring to FIGS. 8 and 9, the shadow mask having a large number of electron beam passing holes is in a rectangular shape with a long side (X) and a short side (Y), and the skirt 15 having a predetermined length (S) is bent perpendicular to the long and short sides of the shadow mask. Also, the skirt 15 includes a slit 17 that serves to prevent the skirt 15 from being wrinkled, a guide slit 18 that is used as a base position during the press-forming process of the shadow mask 3, and an embossment 16 that facilitates the formation of the skirt 15 and reinforces the strength of the skirt 15. In consideration of the current technology for forming the electron beam passing holes on the shadow mask and the mechanical strength of the shadow mask, the shadow mask preferably has a thickness of 0.09–0.17 mm.

The shadow mask 3 fits into the cathode ray tube by welding a welding portion 19 of the skirt 15 onto the inside surface of the mask frame 14. In some cases, the welding portion 19 of the skirt 15 is welded onto an outside surface of the mask frame 14. The former method, i.e. welding the inside surface of the mask frame 14 onto the welding portion 19 of the skirt 15, is better in terms of preventing a doming phenomenon and securing thermal stability of the shadow mask.

The present invention reduces displacement of beam passing holes formed on the shadow mask 3 due to the thermal deformation of the mask frame 14. This is achieved by elongating the skirt 15 of the shadow mask 3. Thus, the skirt 15 is longer than that of the shadow mask 3 according to the related art, so as to position the welding portion 19 to be relatively lower.

Figure 10:
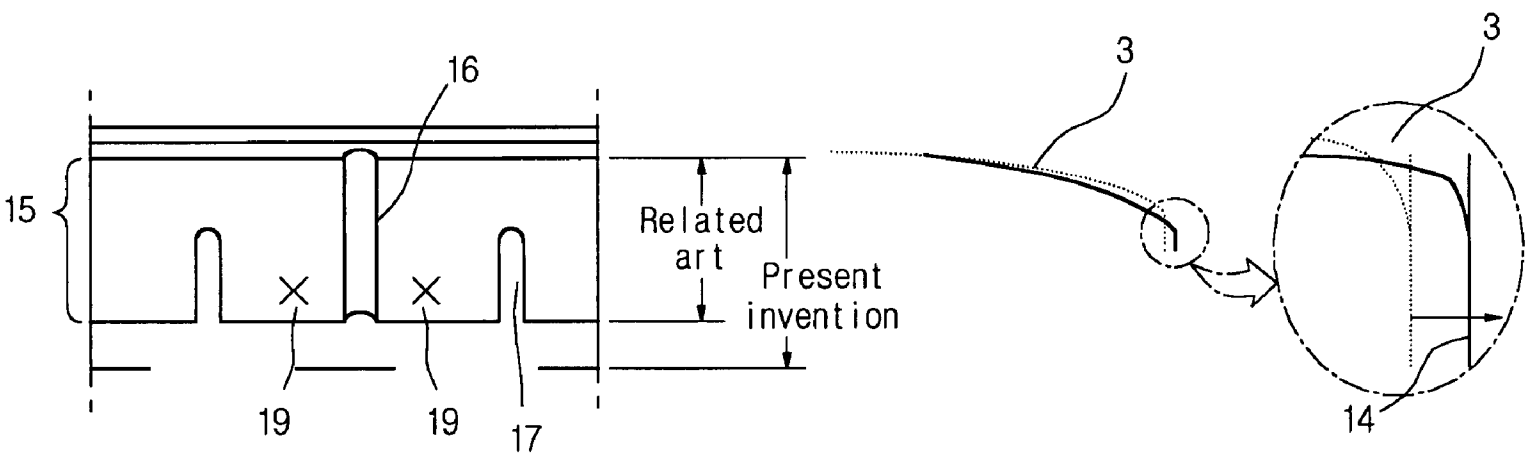
FIG. 10 is a schematic view comparing the shadow mask of the related art to the shadow mask of the present invention where the position of the shadow mask of the present invention is changed because of a deformed mask frame that is welded into a welding portion of the skirt.
Figure 11:
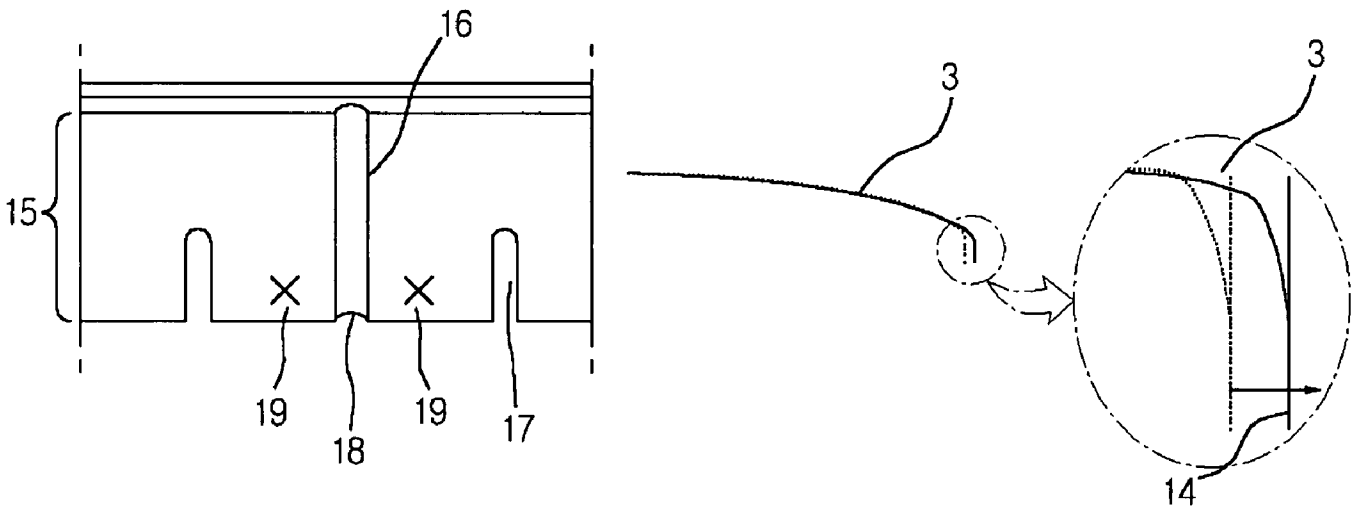
FIG. 11 is a schematic view illustrating the shadow mask for the cathode ray tube according to the present invention and showing the length of the skirt and the displacement of the shadow mask, which are inversely proportional to each other, that is, as the length of the skirt increases, the shadow mask moves little.

FIG. 10 is a schematic view comparing the shadow mask of the related art to the shadow mask of the present invention where the position of the shadow mask of the present invention is changed because of a deformed mask frame that is welded into the welding portion of the skirt. FIG. 11 is a schematic view illustrating the shadow mask for the cathode ray tube according to the present invention and showing the length of the skirt and the displacement of the shadow mask being inversely proportional to each other, that is, as the length of the skirt increases, the shadow mask moves little.

As shown in FIG. 10 and FIG. 11, the skirt 15 of the shadow mask 3 for the cathode ray tube according to the present invention is longer than the skirt 15 of the conventional shadow mask 3, and the welding portion 19 of the skirt 15 is also disposed relatively lower. Therefore, even if the mask frame 14 moves in the direction of the arrow due to thermal expansion, the shadow mask 3 deforms less. In other words, as the welding portion 19 is positioned relatively lower, the shadow mask is less influenced by thermal deformation. To maximize this effect, the welding portion 19 of the shadow mask 3 is formed within a distance of 3 mm from the end of the skirt 15.

Referring back to FIG. 8, S denotes the length of the skirt 15 of the shadow mask 3 and X denotes the length of the long side of the shadow mask 3. Then the ratio (%) of the length of the skirt (S) to the length of the long side (X) beneficially satisfies a condition of $4.1\% \leqq S/X \leqq 5.2\%$.

To obviate any inconvenience of welding and possible degradation of welding, the skirt portion 19 may be at least 2 mm distant from the end of the skirt 15. In considerations of the height of the welding portion 19, an interference with the mask frame 14, and tolerance of welding, the ratio (%) of the length of the skirt (S) to the length of the long side (X) should be not larger than 5.2% and not smaller than 4.1%.

Similarly, in consideration of the height of the welding portion 19, an interference with the mask frame 14, and tolerance of welding, the ratio (%) of the length of the skirt (S) to the length of the short side (Y) should be not larger than 6.8% and not smaller than 5.4%. That is, the ratio (%) of the length of the skirt (S) to the length of the short side (Y) beneficially satisfies a condition of $5.4\% \leqq S/Y \leqq 6.8\%$.

Suppose that the skirt length on the long side of the shadow mask is XS, and the skirt length on the short side of the shadow mask is YS. Then, the skirt length on the long side and the skirt length on the short side beneficially satisfy a relation of $(XS) \leqq (YS)$. Usually, the short side of the shadow mask is more susceptible to the doming phenomenon. Hence, the skirt length on the short side (YS) is made to be relatively longer than the skirt length on the long side (XS) to reduce the doming phenomenon. Accordingly, the two skirt lengths satisfy the condition of $(XS) \leqq (YS)$.

Table 1 below explains changes in a doming degree of the shadow mask for the cathode ray tube according to the present invention.

TABLE 1

| | X | Y | S | Peak value | Best value | Peak value-Base value |
|---|---|---|---|---|---|---|
| Related art | 362 mm | 277 mm | 14 mm | 5 μm | −13 μm | 18 μm |
| Present Invention | 364 mm | 278 mm | 17 mm | 5 μm | −8 μm | 13 μm |

As shown in Table 1, the base value of the doming degree was noticeably lower (up to 5 μm) than that of the related art. The above result is also reflected in the graph of FIG. 12.

Figure 12:
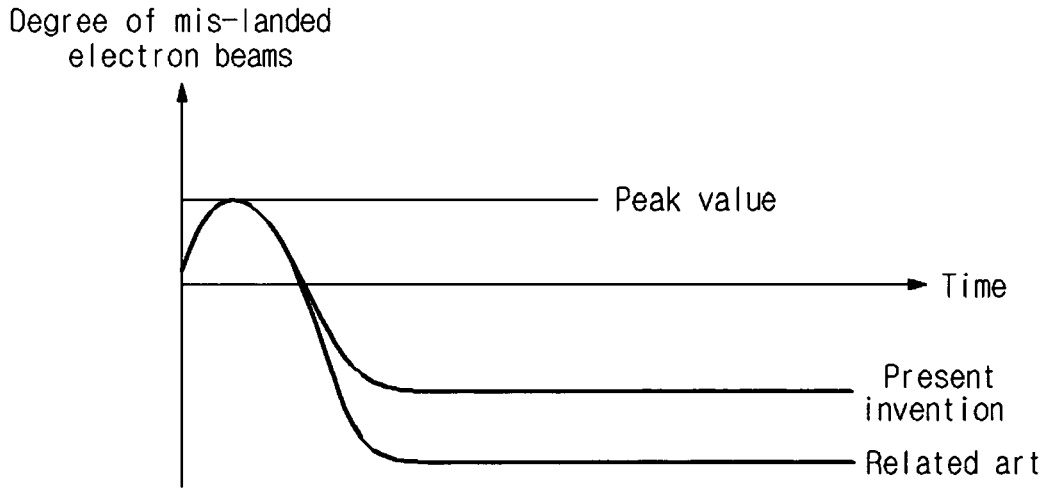
FIG. 12 is a diagram comparing the mis-landing degree of the electron beams on the shadow masks of the present invention and the related art.

FIG. 12 is a diagram comparing the mis-landing degree of the electron beams on the shadow masks of the present invention and related art. As shown in FIG. 12, although the peak value of the degree of mis-landed electron beams of the shadow mask according to the present invention is equal to that of the related art, the difference between the peak value and the base value, namely (peak value−base value), of the present invention is noticeably smaller than that of the related art.

The shadow mask which prevents the doming phenomenon and deterioration of overall color purity according to the present invention can be adopted to TV cathode ray tubes as well as monitor cathode ray tubes.

By making the skirt length of the shadow mask longer than the related art and applying the shadow mask to the cathode ray tube according to the present invention, it is now possible to obviate problems with the doming phenomenon and deterioration of color purity.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cathode ray tube comprising:

a glass panel having a front side;

a funnel attached to the glass panel forming a vacuum envelope;

a fluorescent screen formed on an inside surface of the glass panel;

a shadow mask having a skirt being spaced from the fluorescent screen by a distance, the shadow mask having a short side and a long side;

a mask frame coupled to the shadow mask; an electron gun at a neck portion of the funnel; and a deflection yoke for deflecting electron beams emitted from the electron gun in horizontal and vertical directions, wherein a ratio (%) of a length of the skirt (S) to a length of the long side (X) of the shadow mask is in a range of about 4.1%≦S/X≦5.2%, wherein a height of the skirt on the long side of the shadow mask is less than a height of the skirt on the short side of the shadow mask.

2. The cathode ray tube according to claim 1, wherein the mask frame is welded onto the shadow mask and a welding portion of the skirt of the shadow mask for welding the mask frame onto the shadow mask is formed within a distance of 3 mm from an end of the skirt.

3. The cathode ray tube according to claim 3, wherein the shadow mask is welded onto an inside surface of the mask frame.

4. The cathode ray tube according to claim 1, wherein the skirt of the shadow mask includes a slit or an embossment.

5. The cathode ray tube according to claim 1, wherein an inside surface of the panel has a curvature and an outside surface of the panel is substantially flat.

6. The cathode ray tube according to claim 5, wherein an arbitrary point, P (x, y, z) on the outside surface of the panel satisfies a condition of $$50{,}000\ \text{mm} \le \frac{\sqrt{(x^2+y^2)^2}+z^2}{2z} \le 100{,}000\ \text{mm}.$$

7. The cathode ray tube according to claim 5, wherein a diagonal curvature radius of the inside surface of the panel is in a range of about 1.5R–4R.

8. The cathode ray tube according to claim 1, wherein a diagonal curvature radius of the shadow mask is in a range of about 1.5R–4R.

9. The cathode ray tube according to claim 1, wherein a thickness of the shadow mask is in a range of about 0.09 mm–0.17 mm.

10. The cathode ray tube according to claim 1, wherein the cathode ray tube is a monitor cathode ray tube.

11. The cathode ray tube according to claim 1, wherein a ratio (%) of a length of the skirt (S) to a length of a short side (Y) of the shadow mask is 5.4%≦S/Y≦6.8%.

12. A cathode ray tube comprising:

a glass panel having a front side;

a funnel attached to the glass panel forming a vacuum envelope;

a fluorescent screen formed on an inside surface of the glass panel;

a shadow mask having a skirt being spaced from the fluorescent screen by a distance, the shadow mask having a short side and a long side;

a mask frame coupled to the shadow mask;

an electron gun at a neck portion of the funnel; and a deflection yoke for deflecting electron beams emitted from the electron gun in horizontal and vertical directions, wherein a ratio (%) of a length of the skirt (S) to a length of the long side (Y) of the shadow mask is in a range of about 5.4%≦S/Y≦6.8%, wherein a height of the skirt on the lone side of the shadow mask is less than a height of the skirt on the short side of the shadow mask.

13. The cathode ray tube according to claim 12, wherein the mask frame is welded onto the shadow mask and a welding portion of the skirt of the shadow mask for welding the mask frame onto the shadow mask is formed within a distance of 3 mm from an end of the skirt.

14. The cathode ray tube according to claim 13, wherein the shadow mask is welded onto an inside surface of the mask frame.

15. The cathode ray tube according to claim 12, wherein the skirt of the shadow mask includes a slit or an embossment.

16. The cathode ray tube according to claim 12, wherein an inside surface of the panel has a curvature and an outside surface of the panel is substantially flat.

17. The cathode ray tube according to claim 16, wherein an arbitrary point, P (x, y, z) on the outside surface of the panel satisfies a condition of $$50{,}000\ \text{mm} \le \frac{\sqrt{(x^2+y^2)^2}+z^2}{2z} \le 100{,}000\ \text{mm}.$$

18. The cathode ray tube according to claim 16, wherein a diagonal curvature radius of the inside surface of the panel is in a range of about 1.5R–4R.

19. The cathode ray tube according to claim 12, wherein a diagonal curvature radius of the shadow mask is in a range of about 1.5R–4R.

20. The cathode ray tube according to claim 12, wherein a thickness of the shadow mask is in a range of about 0.09 mm–0.17 mm.

21. The cathode ray tube according to claim 12, wherein the cathode ray tube is a monitor cathode ray tube.

22. A cathode ray tube comprising:

a glass panel having a front side;

a funnel attached to the glass panel forming a vacuum envelope;

a fluorescent screen formed on an inside surface of the glass panel;

a shadow mask with a color selection function and having a skirt with a welding portion, the shadow mask being spaced from the fluorescent screen by a distance and having a short side and a long side, wherein a height of the skirt on the long side of the shadow mask is less than a height of the skirt on the short side of the shadow mask;

a mask frame in the shadow mask, wherein the mask frame is welded to the shadow mask and the welding portion of the skirt of the shadow mask for welding the mask frame to the shadow mask is formed within a distance of 3 mm from an end of the skirt;

an electron gun at a neck portion of the funnel; and a deflection yoke for deflecting electron beams emitted from the electron gun in horizontal and vertical directions, wherein a ratio (%) of a length of the skirt (S) to a length of the long side (X) of the shadow mask is 4.1%≦S/X≦5.2%;

wherein a ratio (%) of the length of a skirt (S) to a length of the short side (Y) of the shadow mask is 5.4%≦S/Y≦6.8%.

23. A cathode ray tube comprising:

a glass panel having a front side;

a funnel attached to the glass panel forming a vacuum envelope;

a fluorescent screen formed on an inside surface of the glass panel;

a shadow mask having a skirt being spaced from the fluorescent screen by a distance, the shadow mask having a short side and a long side;

a mask frame coupled to the shadow mask;

an electron gun at a neck portion of the funnel; and means for deflecting electron beams emitted from the electron gun in horizontal and vertical directions, wherein a ratio (%) of a length of the skirt (S) to a length of the long side (X) of the shadow mask is in a range of about $4.1\% \leqq S/X \leqq 5.2\%$, wherein a height of the skirt on the long side of the shadow mask is less than a height of the skirt on the short side of the shadow mask.

24. A cathode ray tube comprising:

a glass panel having a front side;

a funnel attached to the glass panel forming a vacuum envelope;

a fluorescent screen formed on an inside surface of the glass panel;

a shadow mask having a skirt being spaced from the fluorescent screen by a distance, the shadow mask having a short side and a long side;

a mask frame coupled to the shadow mask;

an electron gun at a neck portion of the funnel; and means for deflecting electron beams emitted from the electron gun in horizontal and vertical directions, wherein a ratio (%) of a length of the skirt (S) to a length of the long side (Y) of the shadow mask is in a range of about $5.4\% \leqq S/Y \leqq 6.8\%$, wherein a height of the skirt on the long side of the shadow mask is less than a height of the skirt on the short side of the shadow mask.

* * * * *